US005911333A

United States Patent [19]

Rotgeri

[11] Patent Number: 5,911,333

[45] Date of Patent: Jun. 15, 1999

[54] VEHICLE HEADLIGHT

[75] Inventor: Gerhard Rotgeri, Geseke, Germany

[73] Assignee: Hella KG Hueck & Co., Lippstadt, Germany

[21] Appl. No.: 08/951,316

[22] Filed: Oct. 16, 1997

[30] Foreign Application Priority Data

Oct. 22, 1996 [DE] Germany ..... 196 43 462

[51] Int. Cl.[6] ..... B65D 45/16

[52] U.S. Cl. ..... 220/326

[58] Field of Search ..... 220/326, 324

[56] References Cited

U.S. PATENT DOCUMENTS

| | | | |
|---|---|---|---|
| 3,394,838 | 7/1968 | Larkin | 220/326 |
| 3,741,433 | 6/1973 | Bentley et al. | 220/326 |
| 4,224,765 | 9/1980 | Song | 220/326 |
| 4,979,634 | 12/1990 | Begley | 220/335 |
| 5,301,829 | 4/1994 | Chrisco | 220/326 |

FOREIGN PATENT DOCUMENTS

| | | |
|---|---|---|
| GM 7605 088 | 2/1976 | Germany . |
| 28 46 990 | 5/1980 | Germany . |

*Primary Examiner*—Stephen Castellano
*Attorney, Agent, or Firm*—Griffin, Butler, Whisenhunt & Szipl, LLP

[57] ABSTRACT

The cover plate and the housing of a vehicle headlight are connected by at least one catch device and a projecting part that engages behind the catch device, which moves in a spring direction, in a self-locking manner. The catch device has a first slip-interface surface which, when viewed in its spring direction, extends at an acute angle to a direction of assembly at every point along the first slip-interface surface. The projecting part has a second slip-interface surface which, when viewed in the direction of assembly of the cover plate, extends at an acute angle to the spring direction of the catch device at every point along the second slip-interface surface.

10 Claims, 1 Drawing Sheet

VEHICLE HEADLIGHT

BACKGROUND OF THE INVENTION

This invention relates to a vehicle headlight comprised of a housing, a light-transmissive self-locking cover plate connected to the housing, at least one catch device constructed as an integral piece with one of the parts to be connected and sprung perpendicularly with respect to a direction of assembly of the cover plate and housing, and at least one projecting part that automatically engages behind the catch device, wherein the catch device that permits the self-locking connection of the housing and the cover plate has a first slip-interface surface.

German patent document DE 28 46 990 A1 discloses a headlight of this type. A front outer edge of a housing supporting a cover plate, which is formed as a saucer-type reflector, has a receiving area for receiving the cover plate. A sealing material is placed into the receiving area. One can use a molded or extruded sealing material inserted into the receiving area, an adhesive placed into the receiving area, or a permanently viscous sealing material. Catch devices are formed on an outside of the receiving area, distributed evenly along an entire circumference on the outer edge of the housing, and pointing in a direction of exiting light. The cover plate has projecting parts on its outer edge area which are directed radially outward with respect to an optical axis, fitting into an opening in the catch device. When the cover plate is positioned on the housing, its projecting parts slide along slip-interface surfaces of the catch devices. The catch devices are thus sprung radially outward with respect to the optical axis until they engage behind the projecting parts in a self-locking manner. A separation between the catch devices and the headlight is not so great as to be disturbing, but the cover plate can become loosened from the housing in an undesired manner, because only a very small end section of the projecting parts of the cover plate can engage in openings in the catch device, owing to a small spring deflection of the catch device.

German registered utility model 76 05 088 discloses a vehicle headlight wherein catch devices are formed at an outer edge of a cover plate, pointing in a direction in which the cover plate is assembled into position. A spring direction of the catch devices runs perpendicular to a radius of an optical axis. A laterally positioned end section of each catch device engages behind a projecting part of the housing, in a self-locking manner. When the cover plate is positioned onto the housing, the projecting parts of the housing slide along leading diagonal parts of the catch devices, until the catch devices engage behind the projecting parts, in a self-locking manner. In this design, the spring deflection of the catch device is very small owing to its short length and because of its broad lateral surfaces that run in the spring direction. Therefore, it is impossible to ensure that the cover plate is securely mounted on the housing.

It is an object of this invention to provide a vehicle headlight as described in the opening paragraph above, wherein a catch device extends outward from the headlight as little as possible, even when (a) a housing is quick and easy to connect by means of long slip-interface surfaces, (b) a spring deflection of the catch device is as small as possible so that material with low elasticity can be utilized, and (c) the cover plate and housing are connected together securely through extensive contact between the catch device and a projecting part.

SUMMARY

According to principles of the invention, the projecting part has a second slip-interface surface extending at all points at an acute angle to a line in the spring direction of the catch device, viewed in a direction of assembly, and the first slip-interface surface of the catch device, viewed in the spring direction, extends at all points at an acute angle to the direction of assembly.

BRIEF DESCRIPTION OF THE DRAWINGS

The invention is described and explained in more detail below using an embodiment shown in the drawings. The described and illustrated features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
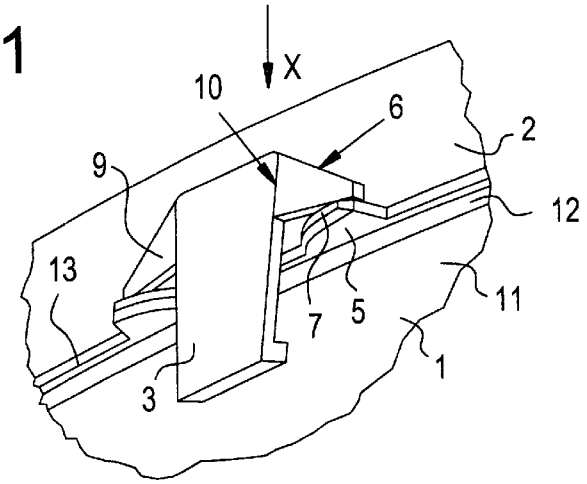
FIG. 1 is a partial perspective view of a cover plate of a vehicle headlight of this invention, positioned on a housing, whereby a catch device of the housing engages behind projecting parts of the cover plate.
Figure 3:
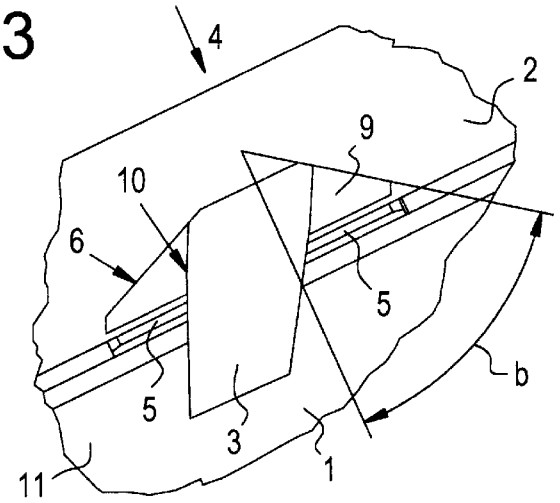
FIG. 3 is a view from direction Y in FIG. 2.
Figure 2:
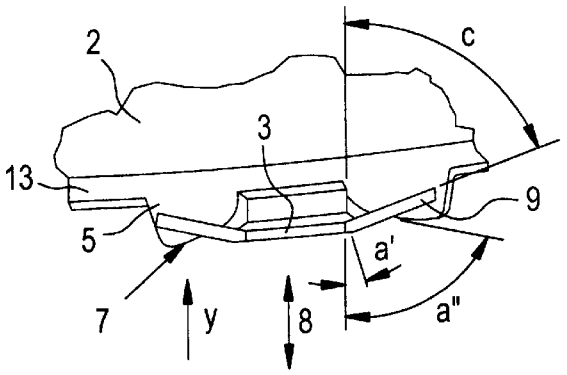
FIG. 2 is a view from direction X in FIG. 1.

According to principles of this invention, a vehicle headlight has a cup-shaped plastic housing 1, a front outer edge 11 of which has a receiving area that is U-shaped in cross-section (not shown). A sealing material is placed into the receiving area. An outer edge area 12 of a saucer-type, light-transmissive plastic cover plate 2 is set into the receiving area on the outer edge 11 of the housing 1. An extruded or molded sealing material, a thermosetting adhesive, or a permanently viscous sealing material can be used as the sealing material between the housing 1 and the cover plate 2. On an outside of the housing 1, at a distance from its outer edge 11, catch devices 3 are formed that are distributed about an entire circumference of its outer edge 11. Each of the catch devices 3 is T-shaped, when viewed radially with respect to an optical axis of the headlight, with a radially-directed lower end portion of a vertical bar of the T being formed on, or fused to, the outside of the housing 1, and a perpendicular cross bar of the T having two end sections 9. Each of the end sections 9 of the catch device 3 engages behind a projecting part 5 of the cover plate 2 in a self-locking manner. The projecting parts 5 are formed on a stiffening rib 13 running around the outer edge area 12 of the cover plate 2. The projecting parts 5, which hold catch devices 3 between them, have second slip-interface surfaces 7 on sides facing each other. The second slip-interface surfaces 7 are convex, when viewed in a direction of assembly 4 of the cover plate 2, forming at every point therealong a projecting-part acute angle a with a radial line from the optical axis, and thus with a line in a spring direction 8 of the catch device 3. The value of each of the acute angles a is at least a' and no greater than a", where a' approaches 0 degrees and a" approaches 90 degrees. The projecting parts 5 have wide lateral faces that extend in planes perpendicular to the direction of assembly 4 of the cover plate 2. Their lateral faces directed opposite to the direction of assembly 4 serve as bearing surfaces for the end sections 9 of the catch devices 3. The catch devices 3 are constructed as clips and have wide lateral faces that extend perpendicular to the spring direction 8 (facing radially). The catch devices 3 have a first slip-interface surface 6 at each of their end sections 9 on a side facing away from the projecting parts 5 (when the cover plate is mounted on the housing) which, when viewed in the spring direction 8 of the catch device 3, each of which extends at a first catch-device acute angle b to the direction of assembly 4. The first slip-interface surfaces 6 can also be convex in shape, like the second slip-interface surfaces 7. Viewed in the direction of assembly 4, the first slip-interface surfaces 6 run at a second catch-device acute angle c, relative to a radial line from the optical axis, that opens toward the headlight. When the cover plate 2 and housing 1 are connected, the first slip-interface surfaces 6 of the catch device 3 slide along the second slip-interface surfaces 7 of the projecting parts 5. Thus the catch devices 3 are sprung outward 8 until the free end sections 9 of the catch devices 3 engage behind the projecting parts 5 of the cover plate 2, in a self-locking manner. The end sections 9 can also be connected to the catch device 3 via nominal bending segments 10. In this case, the catch devices 3 can be rigid up to the lateral end sections 9, with the lateral end sections 9 then being resiliently movable in the direction 8. In this case, it is advantageous for nominal bending lines to be formed by a narrowing of cross-section of the catch device 3, and to extend lengthwise approximately in the direction of assembly 4.

It is advantageous for the projecting-part acute angle a, between the second slip-interface surface and the spring direction, to open away from the headlight, and for the first catch-device acute angle b, between the first slip-interface surface and the direction of assembly, to open toward the projecting part, when the cover plate is mounted on the housing. An edge area protruding outward from the housing or cover plate can serve as a continuous projecting part which is broken in areas of the catch devices. The catch devices and the projecting parts stand very close to the headlight, and are thus not aesthetically disturbing, when the catch device, as viewed in the spring direction, engages behind the projecting part with at least one laterally-positioned end section in a self-locking manner, and thereby forms a clip—the wide lateral faces of which point in the spring direction—and has a first slip-interface surface at its free end. The thinner the walls of the clip, the greater the potential spring deflection of the catch device. In addition, the end sections that engage behind the projecting parts need not be thicker than other portions of the clip.

Particularly extensive contact can be achieved between the catch device and the projecting part if, when viewed in the direction of assembly, the first slip-interface surface of the catch device forms an acute angle with the spring direction, opening toward the headlight. Thus, the projecting part must be relatively long in a radial direction to the optical axis.

During assembly of the cover plate and housing, the catch device and the projecting part can be brought approximately into contact with equal force at every point along their slip-interface surfaces if the second slip-interface surface of the projecting part, viewed in the direction of assembly, and the first slip-interface surface of the catch device, viewed in the direction of the spring, are convex.

Connection of the cover plate and housing can be accomplished with relatively little force if the end sections located at sides of the catch device can pivot about nominal bending segments of the catch device, running approximately in the direction of assembly. When the cover plate and housing are connected, the end sections pivot outwardly about the nominal bending segments and spring back to their normal, original, positions, in which the end sections engage behind the projecting parts in a self-locking manner.

A very stable and secure snap-in connection between the cover plate and the housing is achieved if the catch device is designed in a T shape, viewed in the direction of spring action, with each of the end sections of the perpendicular bar of the T engaging behind a projecting part having a second slip-interface surface, and the longitudinal bar of the T extending between both projecting parts.

In a vehicle headlight wherein the housing has a receiving area for the cover plate on the outer edge, it is also advantageous for the catch device to be formed on the outside of the housing at a distance from the receiving area and to extend a distance beyond the receiving area, with the projecting part being formed at the outer edge area of the cover plate and extending lengthwise perpendicular to the direction of assembly. The cover plate can be made of a rigid material, such as glass. In addition, the catch device can be made to be very long in the direction of assembly. Thus the spring deflection of the catch device at the end sections can be sufficient, even if they are of a material that is relatively inelastic.

While the invention has been particularly shown and described with reference to a preferred embodiment, it will be understood by those skilled in the art that various changes in form and detail may be made therein without departing from the spirit and scope of the invention.

The invention claimed is:

1. An enclosure for a vehicle headlight comprising a housing, a light-transmissive cover plate connected to the housing in a self-locking manner, at least one catch device constructed as an integral piece with one of the housing and cover plate and sprung in a spring direction perpendicularly to a direction of assembly of the cover plate onto the housing, and at least one projecting part fixedly attached to the other of said housing and cover plate for automatically engaging behind said catch device:

wherein said catch device permits a self-locking connection between the housing and the cover plate and has a first slip-interface surface which, when viewed in the spring direction, forms a first catch-device acute angle (b) with a line in the direction of assembly at every point on the first slip-interface surface; and wherein said projecting part has a second slip-interface surface for engaging said first slip-interface surface when said cover plate is placed on said housing which, when viewed in the direction of assembly, extends at a projecting-part acute angle (a) to a line in the spring direction of the catch device at every point on the second slip-interface surface.

2. An enclosure for a vehicle headlight as in claim 1, wherein the projecting-part acute angle (a) opens away from the headlight in the spring direction, and the first catch-device acute angle (b) opens toward the projecting part in the direction of assembly when the cover plate is mounted on the housing.

3. An enclosure for a vehicle headlight as in claim 1, wherein at least one laterally-extending end section of the catch device moves in the spring direction relative to a center section of the catch device to engage behind the projecting part in a self-locking manner.

4. An enclosure for a vehicle headlight as in claim 1, wherein the catch device forms an elongated broad clip having one end portion attached to said one of said housing and cover plate with the other end portion being a free end, wide lateral faces thereof facing in the spring direction, and with the first slip-interface surface being at its free end.

5. An enclosure for a vehicle headlight as in claim 3, wherein, when viewed in the direction of assembly, the first slip-interface surface is on the end section of the catch device and forms a second catch-device acute angle (c) with a line in the spring direction which opens toward the headlight.

6. An enclosure for a vehicle headlight as in claim 1, wherein the second slip-interface surface of said projecting part is concave in shape, when viewed in the direction of assembly.

7. An enclosure for a vehicle headlight as in claim 1, wherein said first slip-interface surface of said catch device is concave in shape, when viewed in the spring direction.

8. An enclosure for a vehicle headlight as in claim 3, wherein said laterally-extending end section can pivot about a nominal bending segment relative to a rest of said catch device.

9. An enclosure for a vehicle headlight as in claim 1, wherein the catch device, when viewed in the spring direction, is T-shaped, with laterally-extending end sections of a perpendicular cross bar of the T engaging behind at least two projecting parts and having the second slip-interface surface thereon, and with a longitudinal bar of the T extending between both projecting parts.

10. An enclosure for a vehicle headlight as in claim 1, in which the housing has a receiving area for receiving a cover plate along its outer edge, wherein the catch device is formed on an outside of the housing at a distance from said receiving area and extends a distance above said receiving area, and wherein the projecting part is formed on outer edge area of the cover plate and extends lengthwise, perpendicular to the direction of assembly.

* * * * *